US005695182A

United States Patent [19]

Sekine

[11] Patent Number: 5,695,182

[45] Date of Patent: Dec. 9, 1997

[54] CORNER SEPARATOR PAPER FEED METHOD AND CASSETTE WHICH PREVENTS PAPER JAMS DURING MANUAL FEEDING

[75] Inventor: Noriaki Sekine, Iwasuki, Japan

[73] Assignee: Ricoh Company, Ltd., Tokyo, Japan

[21] Appl. No.: 593,132

[22] Filed: Feb. 1, 1996

[30] Foreign Application Priority Data

Feb. 1, 1995 [JP] Japan ..... 7-015345

[51] Int. Cl.[6] ..... B65H 3/44; B65H 5/26

[52] U.S. Cl. ..... 271/9.09; 271/9.11; 271/119; 271/170

[58] Field of Search ..... 271/9.09, 9.11, 271/169, 170, 119

[56] References Cited

U.S. PATENT DOCUMENTS

| | | | |
|---|---|---|---|
| 3,339,916 | 9/1967 | Tregay, Jr. | 271/170 |
| 4,449,705 | 5/1984 | Shibuya et al. | 271/9.09 |
| 4,579,328 | 4/1986 | Hagihara et al. | 271/9.09 |
| 4,790,524 | 12/1988 | Murakami et al. | 271/9.09 |

FOREIGN PATENT DOCUMENTS

| | | | |
|---|---|---|---|
| 2361621 | 7/1974 | Germany | 271/9.09 |
| 3707868 | 9/1987 | Germany | 271/9.09 |
| 357067431 | 4/1982 | Japan | 271/9.09 |
| 360012430 | 1/1985 | Japan | 271/9.09 |
| 406107344 | 4/1994 | Japan | 271/170 |
| 406144623 | 5/1994 | Japan | 271/170 |

OTHER PUBLICATIONS

Electrophotography—Bases and Applications, Jun. 15, 1963, Corona Publishing Co., Ltd., Tokyo, Japan, pp. vii–ivx, 336–337, 340–342, along with the partial English translation.

*Primary Examiner*—H. Grant Skaggs
*Attorney, Agent, or Firm*—Oblon, Spivak, McClelland, Maier & Neustadt, P.C.

[57] ABSTRACT

A system and method for feeding paper into an image forming device which allows sheets of paper to be manually fed without becoming jammed. The paper feeding cassette uses one or more corner separators which hold down the corner(s) of the paper in the cassette while a feed roller rotates. The rotation of the feed roller in combination with the corner separators causes one sheet of paper to be removed from the paper cassette. During a manual feed operation in which a user manually feeds a single sheet of paper, a guide plate deflects the manually fed sheet of paper above the corner separators, thus preventing the sheet of paper from becoming jammed under the corner separators.

24 Claims, 9 Drawing Sheets

CORNER SEPARATOR PAPER FEED METHOD AND CASSETTE WHICH PREVENTS PAPER JAMS DURING MANUAL FEEDING

BACKGROUND OF THE INVENTION

1. Field of the Invention

The present invention relates to a method of feeding paper and a corresponding paper cassette for use in a printer, copier machine, facsimile, or other device utilizing paper. The invention is more particularly related to a paper feeding method and cassette which utilizes corner separators and prevents paper jams during a manual feeding operation by deflecting manually fed papers above the corner separators.

2. Discussion of the Background

There are at least two well known methods of feeding paper into image forming devices such as printers, copier machines, and facsimile machines. These two methods are the feed and reverse roller (FRR) method and the corner separator method. The feed and reverse roller feeding mechanism is illustrated in FIGS. 11 and 12 and the corner separator mechanism is illustrated in FIG. 13.

FIGS. 11 and 12 illustrate a paper cassette which utilizes the feed and reverse roller paper feed mechanism. FIG. 11 illustrates automatic feeding from a stack of papers 23, and FIG. 12 illustrates a manual feed operation. In FIG. 11, a stack of papers 23 rests on a paper support 12*a* which is raised by a lever 24 during an automatic feed operation so that the top sheet of the stack of paper contacts a pick-up roller 25. There is a pivoting cover 13 which pivots at point 17*a*, should the stack of papers 23 be pushed up and contact the end of the cover 13. There is also another cover 11 which covers the back of the tray. This feed mechanism also includes a feed roller 27, a reverse roller 28 and a paper sensor 29.

During an automatic feeding operation, the pick-up roller 25 feeds one, or possibly more than one sheet towards the rollers 27 and 28. Should there be only one sheet of paper fed to the rollers 27 and 28, the feed roller 27 rotates clockwise and the reverse roller 28 rotates counter-clockwise due to a rotational force from the feed roller 27 transferred via friction between the rollers and sheet of paper, thus feeding the single sheet of paper to the image forming apparatus. However, if two or more sheets of paper are fed between the feed roller 27 and the reverse roller 28, the reverse roller rotates in the clockwise direction due to a motor as does the feed roller 27. This causes the top sheet to be fed into the image forming apparatus whereas the bottom sheet(s) are returned to the paper cassette. A torque limiter connected to the reverse roller 28 allows the roller 28 to rotate counter-clockwise to feed the paper into the image forming apparatus when there is only one sheet and to rotate clockwise by the force of the motor connected thereto when two or more sheets are fed to the nip between the rollers 27 and 28.

FIG. 12 illustrates the operation of the paper cassette in FIG. 11 operating during a manual feed mode. In this case, a sheet of paper is manually fed to the cover 13 beginning at the position 15. When the manual paper feed sensor 29 detects the manually fed sheet of paper, the pick up roller 25 and feed and reverse rollers 27 and 28 feed a single sheet of paper. During this manual feed operation, the lever 24 may be lowered, if desired, so that paper is not improperly taken from the stack of papers 23. During the manual feed operation, the feed and reverse rollers 27 and 28 operate as described with respect to FIG. 11 so that if the user feeds more than one sheet of paper, only one sheet of paper is fed into the image forming apparatus, due to the reverse rotation of the reverse roller 28. This mechanism provides an effective manner of feeding only a single sheet of paper into an image forming apparatus using either an automatic or manual feed mode of operation.

A negative factor of the feed and reverse roller mechanism illustrated in FIGS. 11 and 12 is that the feed and reverse roller mechanism and associated driving and torqued limiter mechanics require added expense. The corner separator method, discussed below, effectively feeds single sheets of paper from a stack of paper within a paper cassette but does not have the added requirements of the feed and reverse roller mechanism.

FIG. 13 illustrates a manner of feeding single sheets of paper using the corner separation method. In FIG. 13, there is illustrated a stack of papers 52 and a corner separator 4. There is a feeding roller 50 which is in pressured contact with the top sheet of paper P of the stack of paper 52. Friction between the roller 50 and top sheet of paper P is high enough so that the top sheet of paper P is pushed forward and as the corner separator 4 holds down the front corners of the page, the top sheet P flexes, as illustrated in FIG. 13. The flexing or bending action causes the paper to come out from underneath the corner separator 4, thus feeding a single sheet of paper. As the coefficient of friction between the top sheet of paper P and the next lowest sheet is not as high as the coefficient of friction between the feeding roller 50 and the top sheet of paper P, the top sheet of paper P slides along the second highest sheet of paper which allows only one sheet of paper from the stack 52 to be removed.

However, while the corner separation method provides an inexpensive and effective manner of removing a single sheet of paper from a stack of paper within a paper cassette, difficulties arise when a manual feed operation is performed on a single sheet of paper which is also fed using feed roller 50. The inventors have found that by manually feeding a single sheet of paper from a tray which uses the corner separation method, the corner separators might catch the front edge of the sheet of paper being manually fed, thus causing a paper jam.

SUMMARY OF THE INVENTION

Accordingly, it is an object of the invention to provide a simple and inexpensive paper cassette and feeding method which allows both automatic feeding from a paper cassette and a manual feeding of single sheets of paper. It is a further object of the invention to provide a paper feeding method and paper cassette which uses the corner separator paper feed mechanism and still allows individual pieces of paper to be fed and prevents the individual pieces of paper from becoming caught on or jammed in the corner separators.

These and other objects are accomplished using a paper cassette which connects to an image forming device such as a facsimile machine, photocopier, or printer. The paper cassette has corner separators for two corners of sheets of paper which are arranged in a stack within the paper cassette. When a sheet of paper is desired to be fed from the stack in the paper cassette, a feed roller rotates against the top sheet of paper and separates this top sheet using the corner separators. When a manual mode of paper feed is to be performed, the single sheet of paper is set on an upper cover of the paper feeding cassette. Also on the upper portion of the paper cassette is a guide plate which deflects a sheet of paper being manually fed upward and prevents this sheet of paper from being caught under the corner separators and jamming.

The guide plate used to deflect the sheets of paper being manually fed can be constructed to have a variety of features. In one embodiment, the guide plate is slidably arranged to slide into the upper cover of the paper cassette during the automatic feeding operation and to extend towards the corner separators during a manual feed operation. This sliding of the guide plate is performed manually by the user. A further feature of the guide plate is to have notches therein in which fits the feed rollers. This permits the guide plate to remain in an extended position during the manual feeding operation.

As an alternative embodiment, the upper cover of the paper feeding cassette is hinged at an end closest to the guide plate. In order to load the paper cassette with paper, when the upper cover is raised, a torsion coil spring causes the guide plate to pivot downwardly, thus causing the stack of paper inserted into the paper cassette to be guided under the corner separators when being inserted.

In an alternative embodiment, the guide plate is made of a flexible material and connected to the pivoting upper cover. When the upper cover is opened to insert a stack of pages into the paper cassette, the flexible guide plate flexes against the inserted paper in order to guide the paper under the corner separators when being inserted. In yet another embodiment, the guide plate is implemented as a straightened part of the torsion coil spring disposed at the pivot point of the upper cover of the paper feeding cassette. When the upper cover is raised to insert a stack of pages, this spring which is a straightened wire at the end guides the pages under the corner separator.

As yet another embodiment, there is a lever attached to the guide plate near the pivot point of the guide plate. When the upper cover is opened to insert a stack of pages, the guide plate pivots downwardly and the lever contacts a projection on the corner separator, thus raising the corner separator so that the stack of pages which are inserted are not caught under the corner separator.

A further embodiment of the invention includes a lever attached to the cover of the paper cassette. When the paper cassette is opened to insert a sheet of paper, this lever rests against a roller. When the feeding roller starts to rotate, this roller on which the lever is resting also rotates and contacts the lever, thus causing the upper cover to automatically close.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
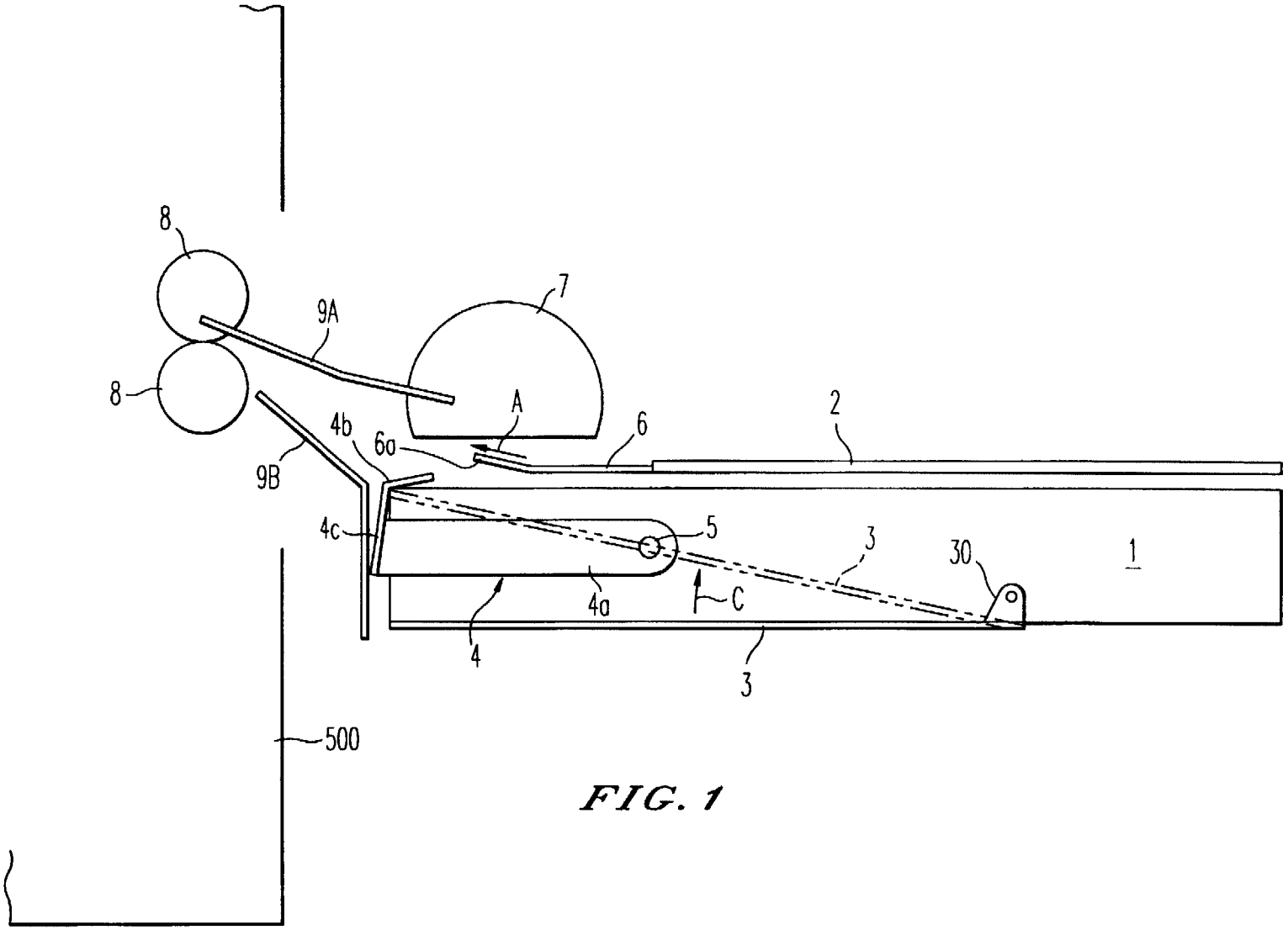
FIG. 1 is a simplified cross-sectional view of a paper feeding cassette and feeding mechanism of a first embodiment of the present invention.

Referring now to the drawings, wherein like reference numerals designate identical or corresponding parts throughout the several views, and more particularly to FIG. 1 thereof, there is illustrated a cross-sectional view of a paper cassette and feeding mechanism constructed according to a first embodiment of the invention. This paper feeding cassette feeds individual sheets of paper out of the paper cassette to a device such as a facsimile machine, a printer, a copier, or any other device which utilizes sheets of paper. While the present invention is discussed with respect to sheets of paper, the term paper in this writing generically refers to any medium on which information can be printed such as clear overhead projection sheets or any type of medium.

In FIG. 1, there is illustrated a paper cassette 1 which is inserted into or mounted to an apparatus such as an image forming apparatus 500. The paper cassette 1 includes an upper cover 2 and a base plate 3. This base plate pivots on the hinge mechanism 30 so that the top sheet of paper is pressed upward against the bottom of the corner separator 4*b*. When the base plate 3 pivots upwardly so that the top sheet of paper is pressed against the bottom of the top portion 4*b* of the corner separator in the direction of the arrow labeled C, the base plate 3 pivots at 30 to the position marked with broken lines. The paper cassette will include one or preferably two corner separating mechanisms 4. The corner separating mechanisms are pivoted at a fulcrum or pivot point 5. There is a side 4*a* of the corner separator mechanism which is connected to the front of the corner separator mechanism 4*c*. The top of the corner separator mechanism, designated by 4*b*, generally has a triangular shape when viewed from above, the tip of the corner separators pointing to the back of the tray. The corner separator mechanisms or simply corner separators are devices which hold down, at least temporarily, corners of sheets of papers which are to be fed from a stack of papers.

There is a feed roller 7 which is preferably not cylindrical in shape but has a flat side, as illustrated in FIG. 1, although it is possible to implement the feed roller 7 using a circular roller or other shaped roller, if desired. One rotation of the feed roller 7 in the clockwise direction will cause the top sheet of paper of the stack of paper within the paper cassette 1 to be removed from under the corner separator 4 and fed between the upper guide 9A and lower guide 9B to a pair of feed rollers 8. The top feed roller rotates in a clockwise direction and the bottom feed roller rotates in a counter-clockwise direction, thus feeding the single sheet of paper into the image forming apparatus. After the feed roller 7 makes a complete 360 degree revolution and feeds the front edge of the sheet of paper to the nip formed between the rollers 8, the feed roller 7 returns to its original position and does not inhibit the feeding of the sheet of paper which is fed into the image forming apparatus using the rollers 8.

When a sheet of paper is manually fed using the paper cassette and feeding mechanism illustrated in FIG. 1, the operator first places the sheet of paper on the top of the upper cover 2. The operator then manually pushes the sheet of paper in the direction labeled A along the top of the upper cover 2 and the guide plate 6. As seen in this cross-sectional view, the guide plate 6 has the end thereof (approximately 3/16 of an inch) near the corner separator **4*b* bent upwardly. This angle is preferably in the range between 0 and 45 degrees, although any appropriate angle can be used. The angle is more preferably between 5 and 15 degrees and the angle utilized in a prototype of the invention is approximately 9 degrees. This angle causes the sheet of paper being manually fed to be deflected upwardly and not be caught underneath the corner separator 4*b*. The sheet of paper is further pushed manually by the operator until it reaches the nip between the feed rollers 8 which then feed the paper into the image forming apparatus. In this embodiment, as the user pushes the sheet of paper to the nip between the rollers 8, it is not necessary for the feed roller 7 to rotate during the manual feed operation. However, if desired, the feed roller 7 can rotate to feed the sheet of paper during a manual operation up to the nip between the rollers 8**.

FIG. 1 illustrates that there is no overlap between the guide plate 6 and the corner separator **4*b*. However, it is perfectly acceptable to modify the illustrated guide plate to extend the guide plate 6 so that the end 6*a* extends over the top portion of the corner separator 4*b*, is aligned with the end of the top portion of the corner separator 4*b*, or is in the position as illustrated. The exact position of this guide plate 6 may be chosen as desired so that its function of deflecting upwardly the sheet of paper above the top portion of the corner separator 4*b* is accomplished. As long as the manually fed paper is not caught under the corner, the invention will carry out its intended function. As a concrete example, the separation between the end 6*a* of the guide plate 6 and the end of the corner separator 4*b* closest to 6*a* can be anywhere between 0, 1, 2, 3, 4, 5, or more millimeters from each other. Further, there may be overlap of between 0 and 5 or more millimeters of the end of the guide plate 6*a* and the top of the corner separator 4*b***.

Figure 2:
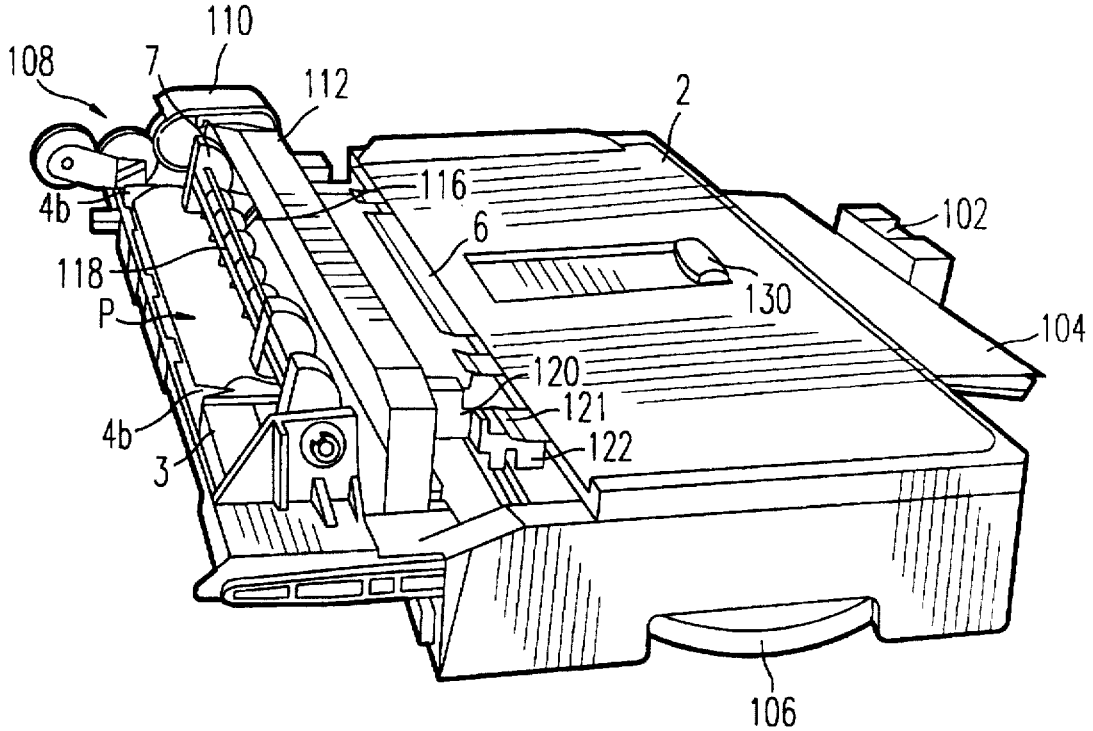
FIG. 2 is a perspective view of a paper feeding cassette constructed according to the first embodiment of the invention.

FIG. 2 is a perspective view of a paper cassette which has been constructed in accordance with the first embodiment illustrated in FIG. 1. A detailed description of the reference numerals previously described with respect to FIG. 1 will not be repeated with respect to the description of FIG. 2. In FIG. 2, an adjustable paper stop 102 contacts the end of a stack of sheets of paper 104. This paper stop 102 can be moved to different positions in connection with different size sheets of paper loaded into the paper cassette. The paper cassette includes a dial 106 which is set by the user to correspond to the size of the paper within the cassette. This dial 106 merely informs the image forming apparatus of the size of the paper within the cassette via an electrical connection. The wheel 106 does not adjust the size of any paper fences within the cassette. However, there is an adjustable side fence 120 of the paper cassette. This adjustable fence 120 has a locking mechanism 122 which when released allows the fence 120 to slide along the width of the paper cassette in order to accommodate different sizes of paper. The locking mechanism 122 includes a release button 121 which when pressed releases the fence 120 from teeth on the paper tray which engage with corresponding teeth of the locking mechanism 122. One of the corner separator mechanisms 4 is connected to this adjustable side fence so that the corner of the paper within the cassette aligns with the corner separator.

Figure 13:
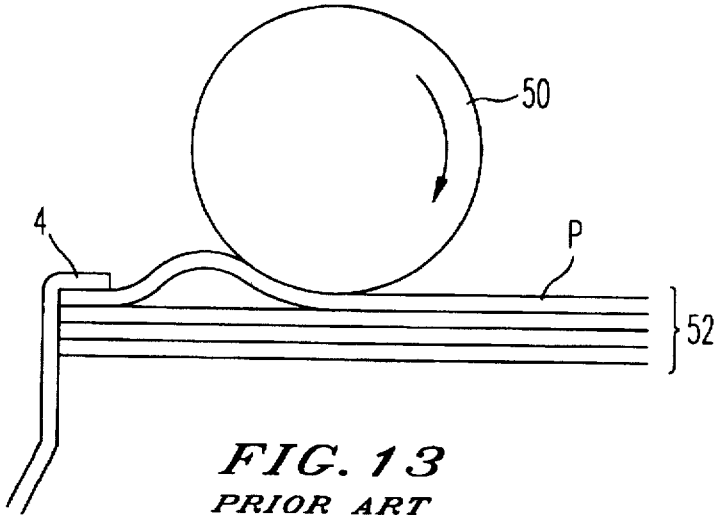
FIG. 13 PRIOR ART
FIG. 13 illustrates the manner in which a conventional corner separation paper feed operation is performed.

In FIG. 2, it is seen that the feeding roller 7 along with the shaft 118 connecting the feeding rollers have rotated a little more than one-quarter of a revolution counter-clockwise from the position illustrated in FIG. 1. This causes the top sheet of paper P to flex as illustrated in FIG. 2 and in a similar manner as illustrated in FIG. 13. As illustrated in FIG. 2, the position of the shaft 118 is fixed relative to the paper tray. The rotation of the shaft 118 is caused by a gear mechanism generally designated as 108. There is a cover 110 for this mechanism which prevents injury of a user and clothing from being caught within the gears. The gear mechanism 108 contains a mechanism such as a solenoid controlled clutch designated by 140 in FIG. 5 which causes the rotation of the shaft 118 and feed roller 7 to stop once the feed roller 7 returns to the position illustrated in FIG. 1. A motor (not illustrated) of the image forming device drives the gear mechanism 108 based on the signals from a control device such as a microprocessor or other processing device within the image forming device.

The paper cassette includes a guard 112 which extends along the width of the cassette and prevents a user from inserting his fingers to a position near the shaft 118 and feed rollers 7. The guard 112 also supports a paper sensor 116. This paper sensor is used to detect that a sheet of paper is being manually fed and causes the feed rollers 8 to begin rotation due to a means for rotating. The sensor 116 can also be used to detect that the paper tray is empty.

Figure 3:
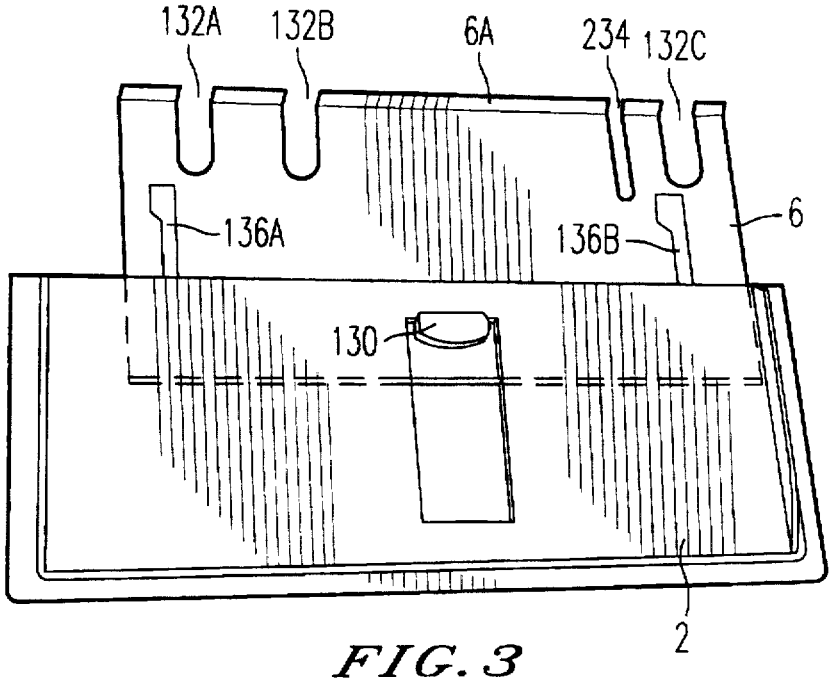
FIG. 3 illustrates the upper cover of the paper feeding cassette having a slidable guide plate.

In FIG. 2, the guide plate 6 is slidably mounted to the upper cover 2. There is a protrusion 130 which allows the guide plate 6 to be extended by a use. FIG. 3 is a detailed illustration of just the guide plate 6 and the upper cover 2. This mechanism including the guide plate 6 and upper cover 2 is removable from the paper tray and rests on top of the paper tray. The cover may include pins which mate with the paper tray to keep the cover from sliding. In this embodiment, it can be seen that there are three notches 132A, 132B and 132C which mate with the three feed rollers 7 illustrated in FIG. 2. This allows the guide plate 6 to be fully extended to be directly above the corner of the top of the corner separator **4*b*. Accordingly, the feed roller 7 can rotate, even when the guide plate 6 is fully extended. However, if desired, the guide plate 6 may be mounted close to the shaft 118 so that the shaft 118** cannot rotate when the guide plate is extended thereunder.

The guide plate 6 also contains a groove 234 for accommodating the sensing mechanism of the paper sensor 116. The guide plate 6 also includes two grooves 136A and 136B which allow the guide plate 6 to smoothly slide along corresponding pins (not illustrated) within the upper cover 2.

Figure 4:
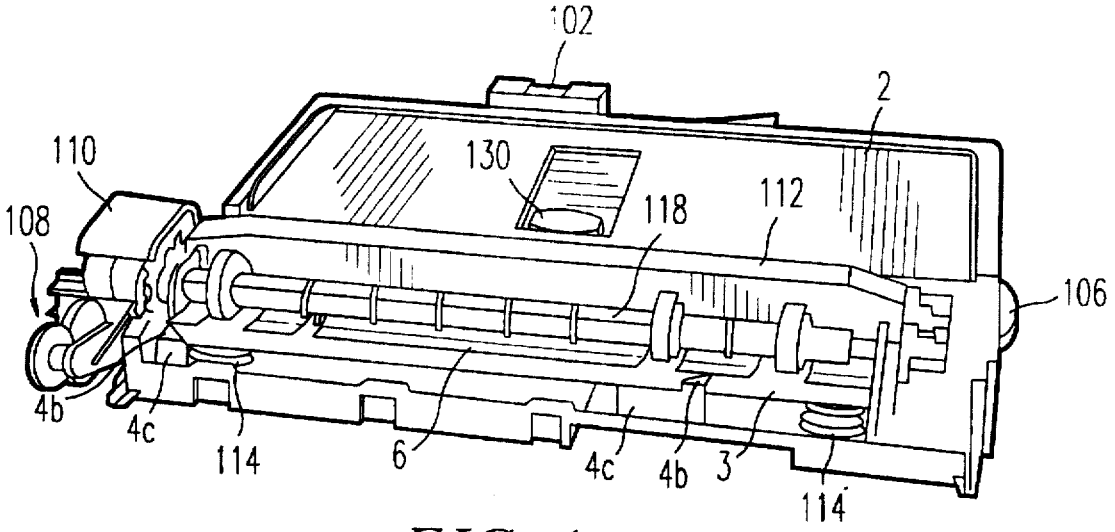
FIG. 4 is a front view of the paper feeding cassette according to the first embodiment.

FIG. 4 illustrates a front view of the paper cassette illustrated in FIG. 2. In this figure, the top **4*b* of the corner separators are clearly seen to have a triangular shape with the tip of each corner separator 4b pointing towards the paper stop or fence 102. In this figure, it can be seen that the protrusion 130 is in a position such that the guide plate 6 is fully extended. In this position, the end of the guide plate 6 just covers the ends of the top of the corner separators 4b. In this figure, the front portions 4c** of the corner separators are also visible.

Also illustrated in this figure are two springs 114 which push the base plate 3 of the paper cassette upward so that the paper contacts the underside of the corner separator portion 4b.

Figure 5:
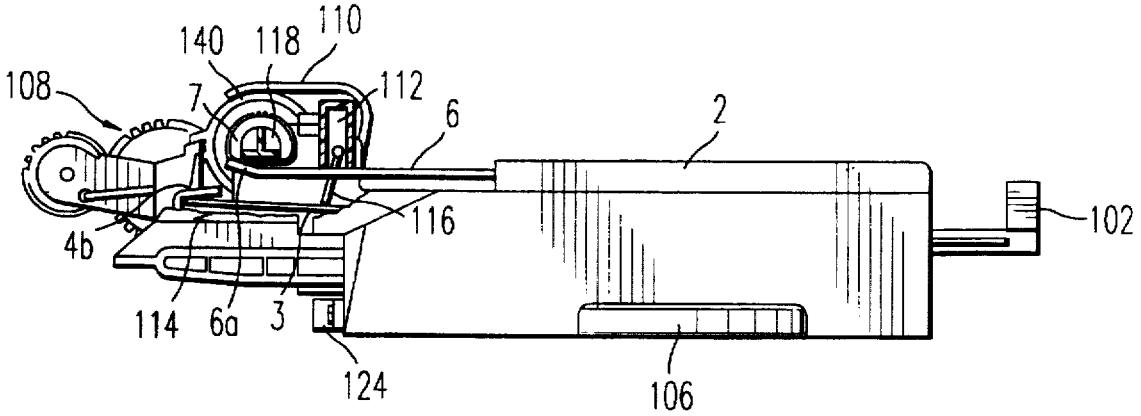
FIG. 5 is a detailed cross-sectional view of a paper feeding cassette constructed according to the first embodiment of the invention.

FIG. 5 illustrates a cross-sectional view of the paper cassette illustrated in FIGS. 2 and 4. In this figure, the guide plate 6 is extended to a position just before the tip of the corner separator 4b. It is clearly seen in this figure that paper which is manually fed along the top of the cover 2 and the guide plate 6 cannot become caught or jammed under the corner separator. Also illustrated in this figure is that the shape of the shaft 118 is flat on one side, in correspondence with the flat shape of the feed roller 7. This allows a sheet of paper to be manually pushed along the top of the guide plate 6 without contacting the shaft 118 or the feed roller 7. Also illustrated in this figure is an electrical connector 124 which allows signals from the selector dial 106, the sensor 116, and any clutch mechanism used to control the rollers to be connected to the image forming apparatus.

Figures 6A, 6B:
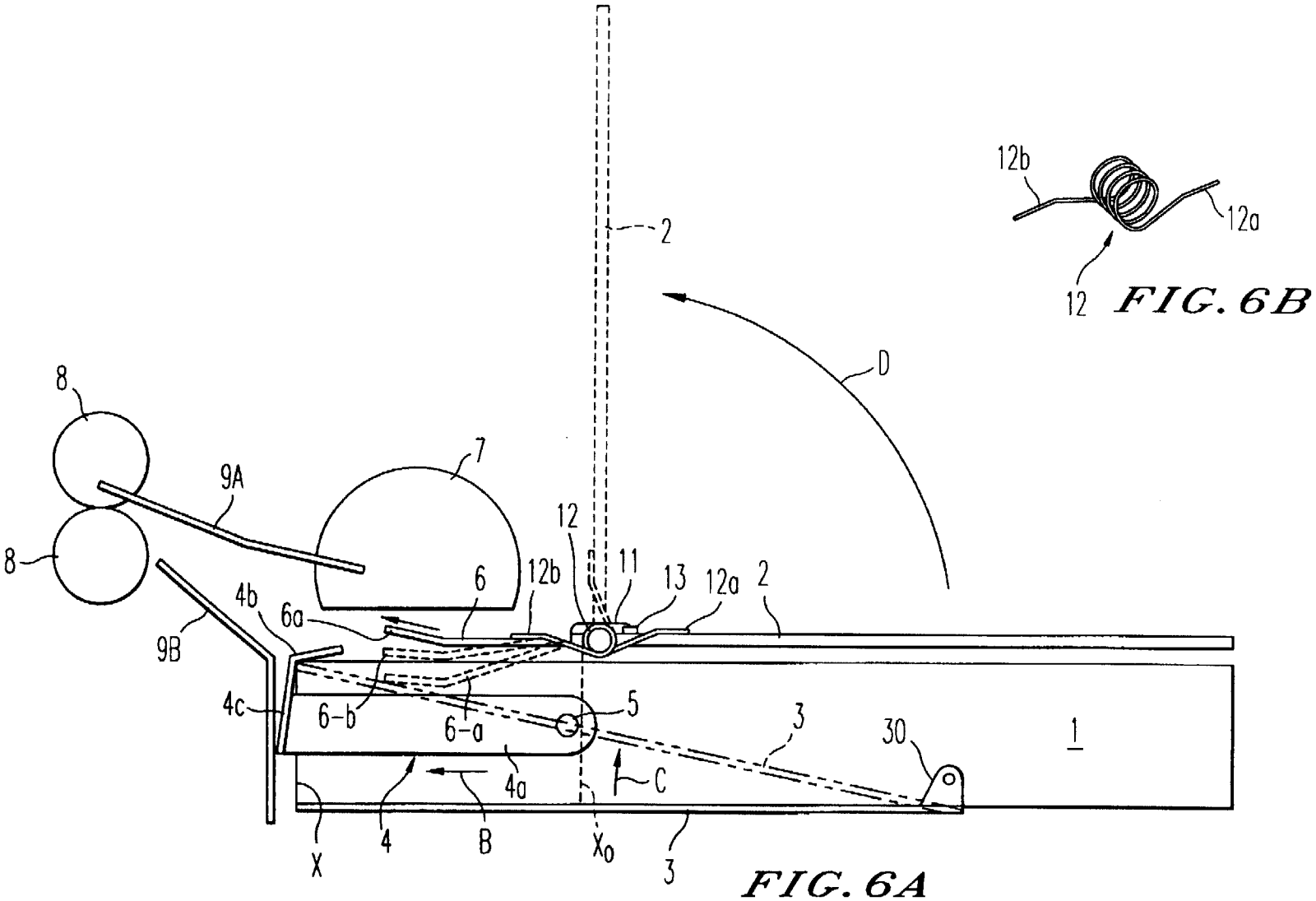
FIG. 6A is a cross-sectional view of a paper feeding cassette and mechanism according to a second embodiment of the invention which uses a torsion coil spring which lowers the guide plate when the upper cover is opened to insert a stack of paper.
FIG. 6B is a perspective view of the torsion coil spring used in the paper feeding cassette illustrated in FIG. 6A.

FIG. 6A illustrates a cross-sectional view of a second embodiment of the invention. In this embodiment, the upper cover 2 of the paper cassette is pivotally mounted on a shaft or hinge 11. Also, the guide plate 6 is mounted on this hinge. One leg 12a of the torsion coil spring 12 contacts the upper cover 2 while the other leg 12b of the torsion coil spring 12 contacts the guide plate 6, as illustrated. There is a stopper 13 which supports the upper cover 2 when closed. In this embodiment, when the cover 2 is raised in a direction D, the guide plate 6 lowers from the position illustrated with the solid line down to position 6-a, when there is no paper in the cassette. When the cover is lifted and a stack of papers inserted into the cassette beginning at point $X_O$, as the stack of papers is pushed forward to position X in the direction designated by the arrow B, the base plate is lowered to the position illustrated with the solid line and the guide plate 6 is raised to the position 6-b. Accordingly, as the papers are pushed forward, the guide plate guides the paper under the paper separator 4b, preventing the paper from improperly rising above the corner separator 4b. When the cover 2 is returned to the closed position, the guide 6 returns to the position illustrated with solid lines and does not touch the full stack of papers within the cassette so that the automatic feeding operation occurs without being improperly disturbed by the guide plate 6. FIG. 6B illustrates a perspective view of the torsion coil spring 12.

Figure 7:
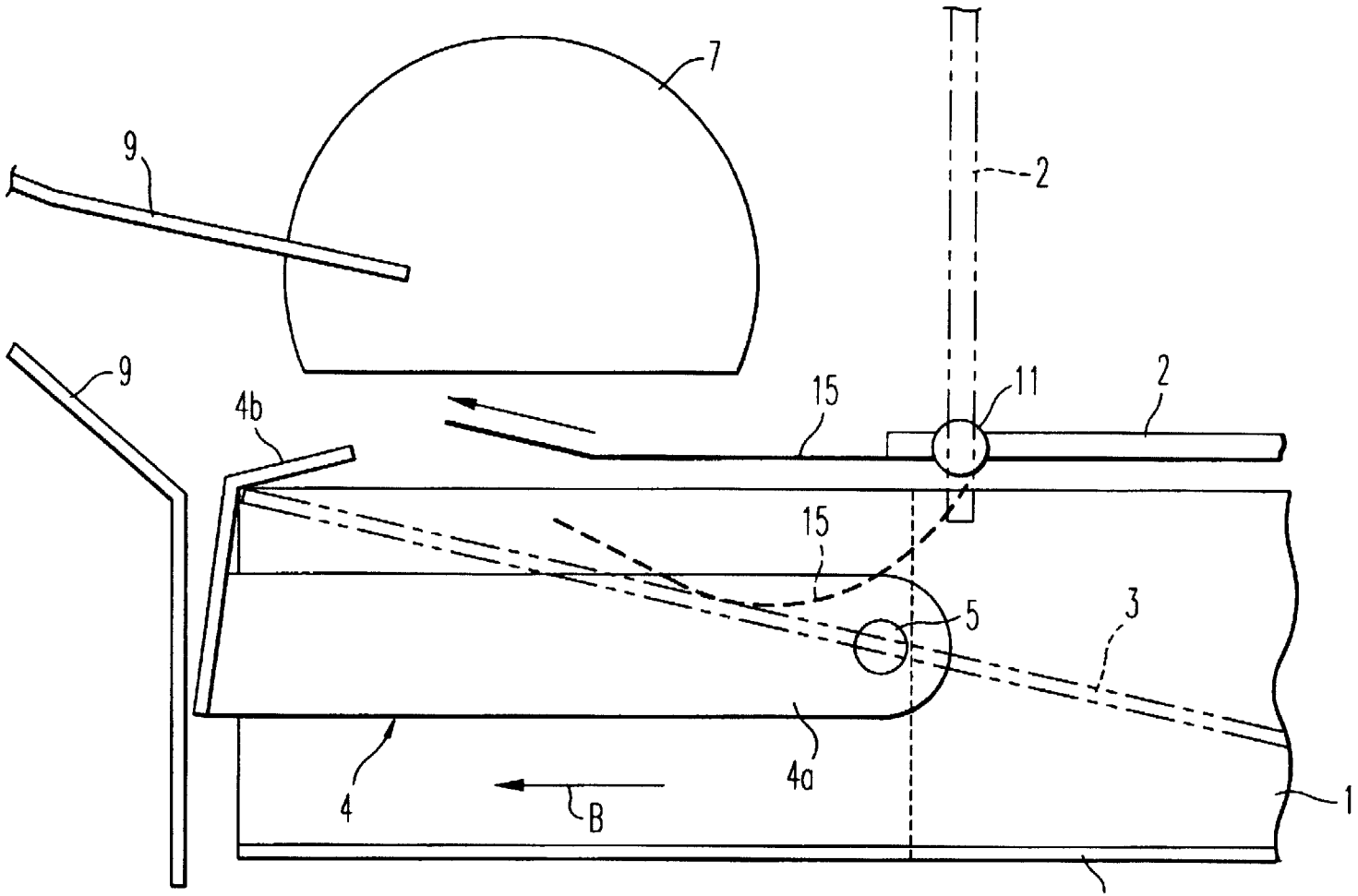
FIG. 7 illustrates a cross-sectional view of a third embodiment of the invention in which the guide plate is implemented using a flexible material such as a leaf spring.

FIG. 7 illustrates a third variation of the construction of the guide plate. In this embodiment, the guide plate is constructed of a flexible material and designated by reference numeral 15. When the cover 2 is moved from the closed position to the open position, the flexible guide plate 15 moves from the position designated by the solid line to the position designated by the broken line. While not clearly illustrated in FIG. 7, the bend in the guide plate 15 when in the position illustrated by the solid line may also remain when the guide plate 15 is moved to the position designated by the broken line. The guide plate 15 which is flexible may be constructed of a leaf spring, made of metal, any type of plastic, or any other desired material which will allow the invention to operate as intended. The reasons why the guide plate 15 press downward towards the base plate 3 and the advantages thereof are the same as for the embodiment illustrated in FIG. 6A.

Figure 8:
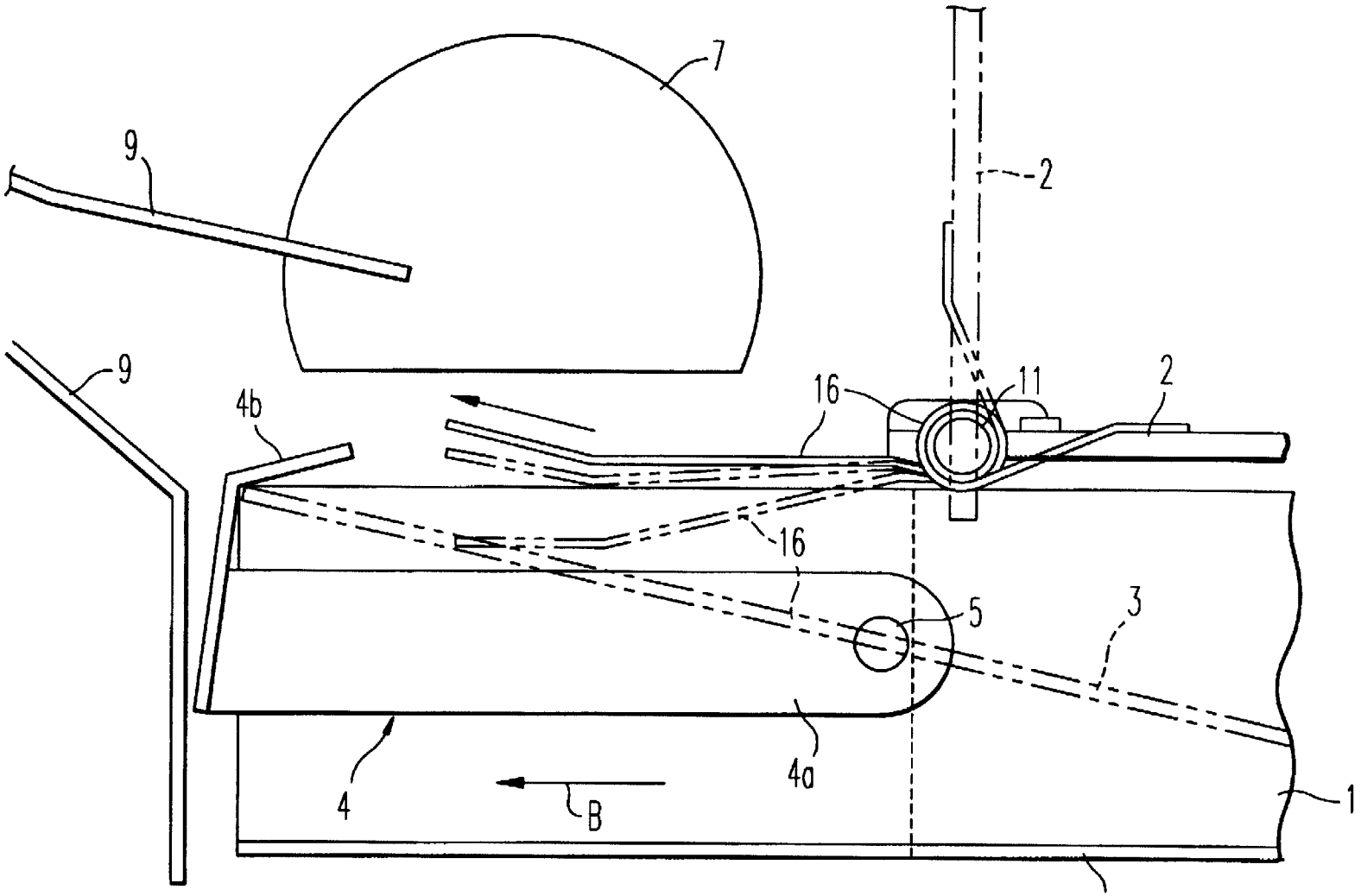
FIG. 8 is a cross-sectional view of a fourth embodiment of the invention in which the guide plate is implemented using a torsion coil spring.

FIG. 8 illustrates yet another manner in which the guide plate can be constructed. In this embodiment, the guide plate is made of a torsion coil spring which has similarities to the spring 12 illustrated in FIGS. 6A and 6B. However, the spring has a long extended leg which serves as the guide plate. This long leg 16 has the general appearance of a wire. This guide plate and its movement from the positions illustrated by the solid and broken lines is similar to the movement of the guide plate 6 illustrated in FIG. 6A.

Figure 9:
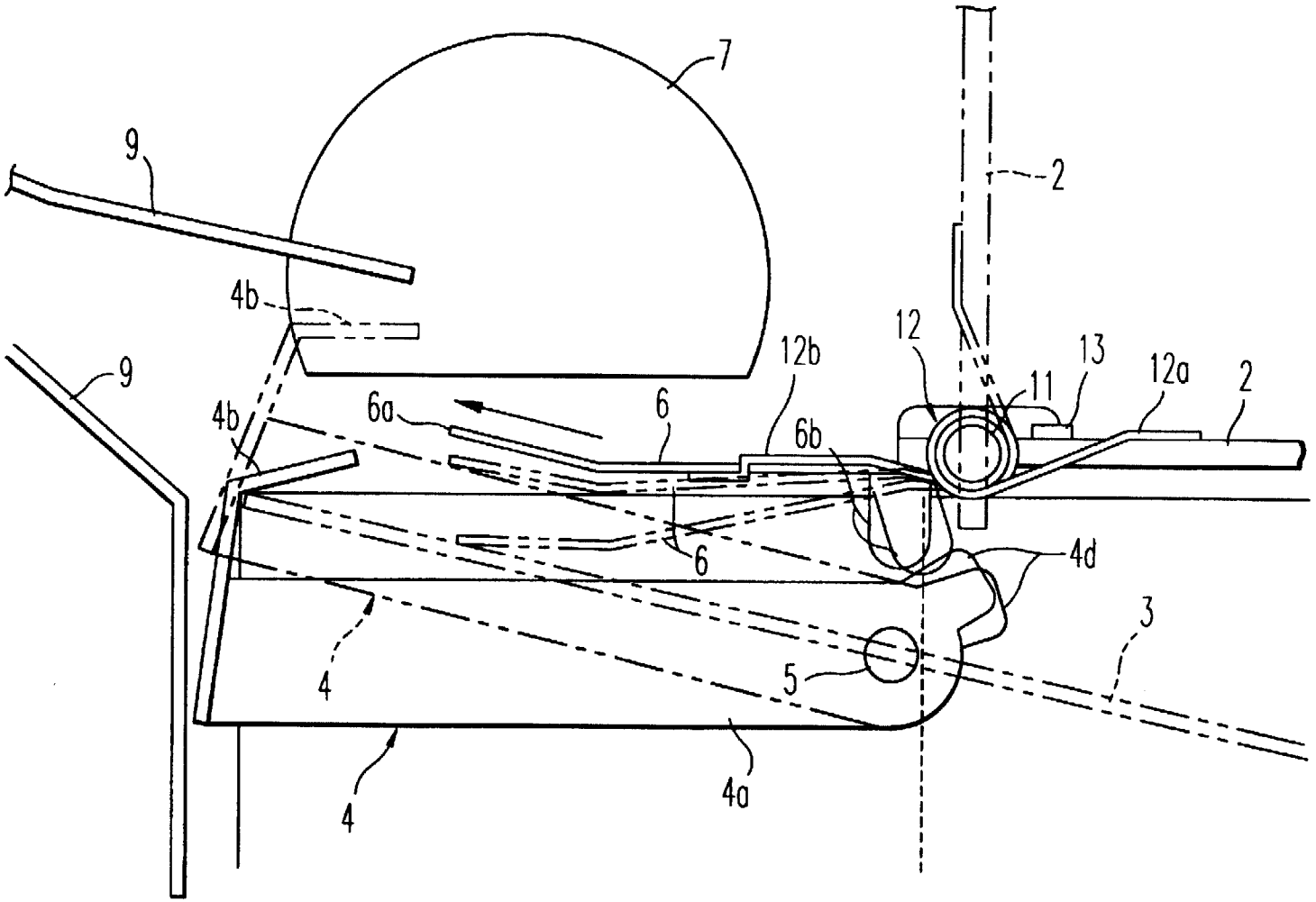
FIG. 9 is a cross-sectional view of a fifth embodiment of the present invention utilizing a projection which contacts the corner separators in order to raise the corner separators when the upper cover of the paper cassette is raised.

FIG. 9 illustrates an embodiment of the invention in which the guide plate 6 is pivotally mounted to a fulcrum or pivot point 11 and a torsion coil spring 12 relates the movement of the cover 2 and the guide plate 6 in a similar manner as illustrated in FIG. 6A. However, this embodiment additionally includes a lever 6b attached to each of the guide plates. Further, the side 4a of the corner separators include a projection 4d at an opposite side of the fulcrum or pivot point 5 as the corner separator upper portion 4b.

When the cover 2 is raised, the guide plate 6 lowers to the position illustrated with broken lines, in a similar manner as the embodiment illustrated in FIG. 6A. However, the downward pressing action of the lever 6b on the projection 4d causes the corner separators to pivot and be raised. This prevents the paper from being jammed or improperly caught under the upper portion 4b of the corner separators.

Figure 10:
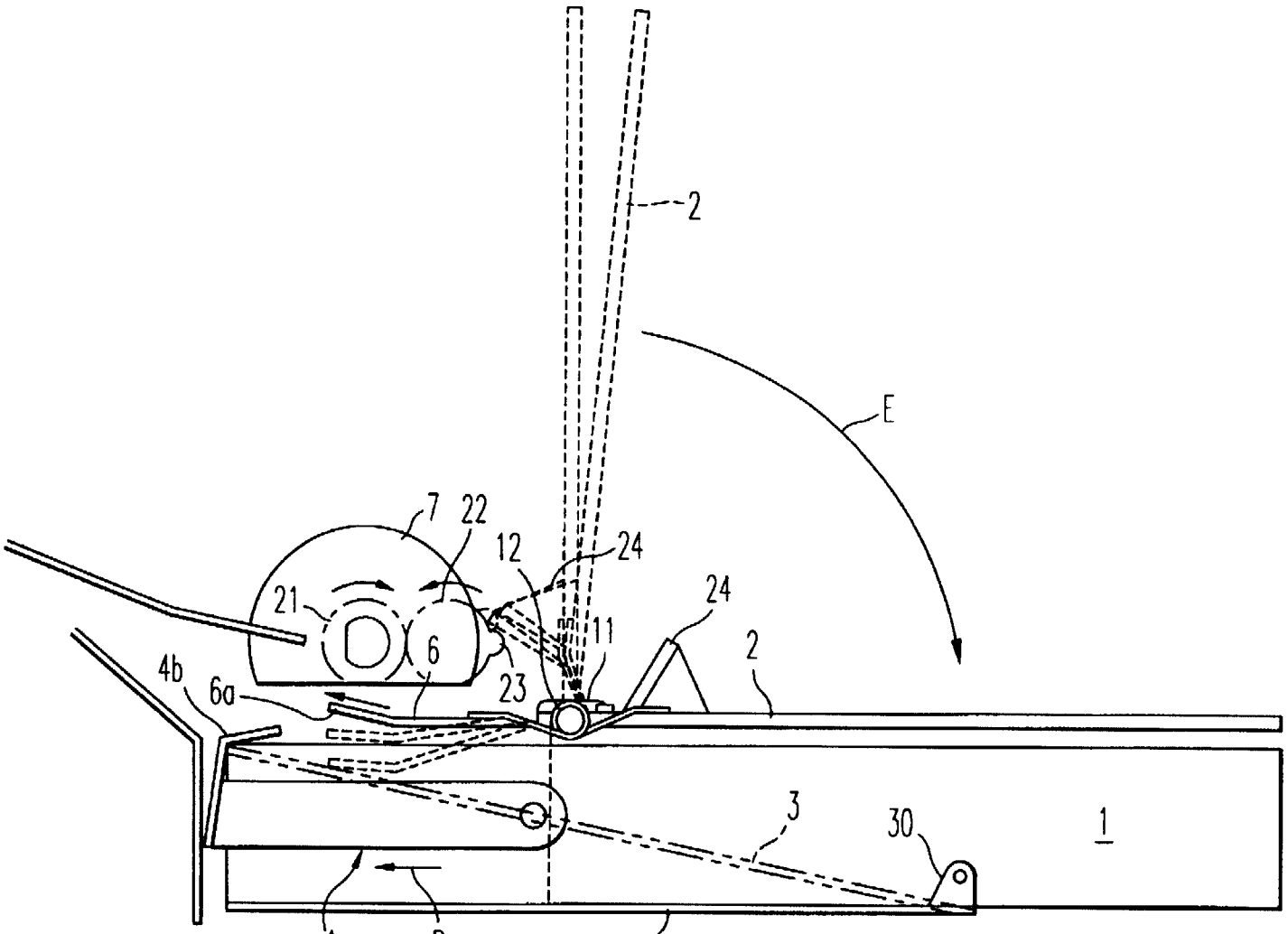
FIG. 10 illustrates a sixth embodiment of the invention in which the upper cover of the paper cassette is automatically closed by the rotation of a paper feeding roller.
Figure 11:
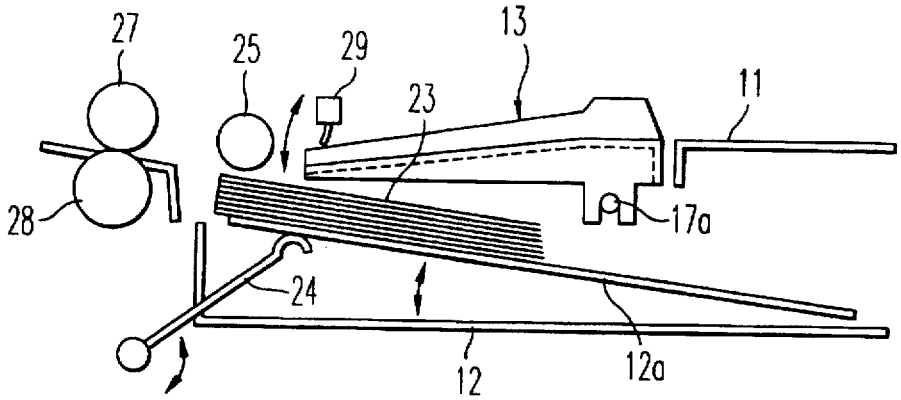
FIG. 11 PRIOR ART
FIG. 11 illustrates a prior art feed and reverse roller feeding mechanism in which individual sheets of paper are automatically fed from a stack of sheets.
Figure 12:
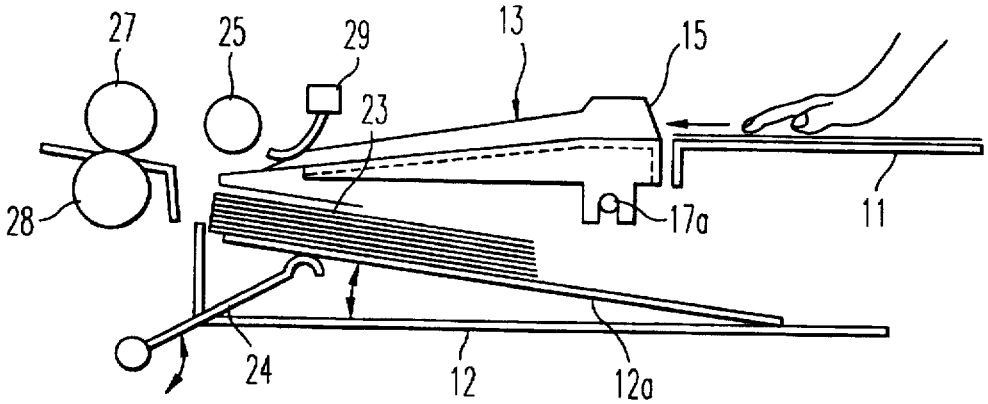
FIG. 12 PRIOR ART
FIG. 12 illustrates a manual feeding mode utilizing the paper cassette illustrated in FIG. 11.

FIG. 10 illustrates another embodiment of the invention in which the cover 2 is automatically closed by the rotation of the paper feeding roller 7, when the cover 2 is left open. The embodiment illustrated in FIG. 10 is similar to the embodiment illustrated in FIG. 6A but additionally includes the shaft 118 of the feed roller 7, a gear 21 mounted on the shaft 118, and a gear 22 which meshes with the gear 21. The number of teeth of the gear 22 is the same as the number of teeth of the gear 21. The gear 22 has a projection 23 mounted to the side thereof which does not interfere with the meshing with the gear 21.

The upper cover 2 includes a lever or projection 24 on its upper side near the pivot point 11. When in the open position, this lever 24 is in the position illustrated using broken lines, and rests against a position of the projection 23. After the cover is opened and a new stack of papers is placed within the cassette 1, the paper feeding roller 7 rotates in a clockwise direction during an automatic feed operation, causing the gear 22 and projection 23 to rotate in a counter-clockwise direction. When the projection 23 contacts the lever 24, the projection 23 pushes the lever in a manner which causes the upper cover 2 to rotate in a clockwise direction designated with the arrow E in order to close the cover 2. After a certain amount of movement of the cover 2 from the open position, the weight of the cover 2 causes the cover 2 to completely close. A stopper 13 is used to stop the movement of the cover 2 when the cover 2 reaches a closed position.

Obviously, numerous modifications and variations of the present invention are possible in light of the above teachings. It is therefore to be understood that within the scope of the appended claims, the invention may be practiced otherwise than as specifically described herein. As an example the different features of the present invention can be applied to the various embodiments which have been described.

What is claimed as new and is desired to be secured by Letters Patent of the United States is:

1. A mechanism for feeding single sheets of paper manually, and automatically from a stack of papers, comprising:

a paper tray for holding the stack of papers, at least one corner separator mounted within the tray;

a feed roller; and a guide plate having a groove at an end thereof for accommodating the feed roller when the guide plate is at a manual feed position, the guide plate deflecting manually fed papers from being caught under the at least one corner separator when the guide plate is at the manual feed position, wherein the feed roller has a flat surface and is mounted to a shaft which is fixed in position with respect to the paper tray, the feed roller engaging with a top sheet of paper from the stack of papers and feeding the top sheet of paper out of the stack of papers during an automatic feeding operation, and the feed roller remaining stationary during the manual feed operation.

2. A mechanism according to claim 1, further comprising:

a pair of rollers which receive sheets of paper which have been fed manually and from the stack of papers using the feed roller.

3. A mechanism according to claim 2, further comprising:

a paper detection sensor which senses a sheet of paper being manually fed.

4. A mechanism according to claim 3, further comprising:

means for rotating said pair of rollers when the paper detection sensor senses the sheet of paper being manually fed.

5. A mechanism according to claim 3, wherein:

the guide plate includes a notch for accommodating the paper detection sensor.

6. A mechanism according to claim 3, wherein:

said pair of rollers are rotated when the paper detection sensor senses the sheet of paper being manually fed.

7. A mechanism according to claim 1, wherein the guide plate has an end thereof angled so that the manually fed papers are deflected upwardly.

8. A mechanism according to claim 7, wherein:

the guide plate has the end thereof angled upward between 5 and 15 degrees.

9. A mechanism according to claim 1, wherein:

the guide plate is slidably extendable from an automatic feed position towards the at least one corner separator to the manual feed position.

10. A mechanism according to claim 1, wherein:

the guide plate includes an end proximate to a tip of the at least one corner separator, the end of the guide plate extending over the tip.

11. A mechanism according to claim 1, wherein:

the guide plate includes an end proximate to a tip of the at least one corner separator, the end of the guide plate being aligned with the tip.

12. A mechanism according to claim 1, wherein:

the guide plate includes an end proximate to a tip of the at least one corner separator, the end of the guide plate ending before a tip of the corner separator begins so that the guide plate and the tip of the at least one corner separator do not overlap.

13. A mechanism according to claim 1, wherein:

one of the at least one corner separators is mounted to a side fence which is slidably mounted to accommodate different size paper in the paper tray.

14. A mechanism according to claim 1, wherein:

the paper tray includes an upper cover which is connected to the guide plate.

15. A mechanism according to claim 1, further comprising:

an image forming device, connected to the paper tray, for forming images on the single sheets of papers.

16. A mechanism according to claim 1, wherein:

the feed roller is rotatable when the guide plate is at the manual feed position.

17. A mechanism for feeding single sheets of paper manually, and automatically from a stack of papers, comprising:

a paper tray for holding the stack of papers, a feed roller; and a guide plate having a groove at an end thereof for accommodating the feed roller when the guide plate is at a manual feed position, the guide plate deflecting manually fed papers from being caught in the paper tray when the guide plate is at the manual feed position, wherein the feed roller has a flat surface and is mounted to a shaft which is fixed in position with respect to the paper tray, the feed roller engaging with a top sheet of paper from the stack of papers and feeding the top sheet of paper out of the stack of papers during an automatic feeding operation, and the feed roller remaining stationary during the manual feed operation.

18. A mechanism according to claim 17, wherein:

the feed roller is rotatable when the guide plate is at the manual feed position.

19. A mechanism according to claim 17, wherein:

the guide plate is slidably extendable from an automatic feed position towards the at least one corner separator to the manual feed position.

20. An image forming apparatus which receives single sheets of paper manually, and automatically from a stack of papers, comprising:

an image forming device having a paper path;

a paper tray for holding the stack of papers, at least one corner separator mounted within the tray;

a feed roller; and a guide plate having a groove at an end thereof for accommodating the feed roller when the guide plate is at a manual feed position, the guide plate deflecting manually fed papers from being caught under the at least one corner separator when the guide plate is at the manual feed position, wherein the feed roller has a flat surface and is mounted to a shaft which is fixed in position with respect to the paper tray, the feed roller engaging with a top sheet of paper from the stack of papers and feeding the top sheet of paper out of the stack of papers to the paper path of the image forming apparatus during an automatic feeding operation, and the feed roller remaining stationary during the manual feed operation.

21. An image forming apparatus according to claim 20, wherein:

the guide plate is slidably extendable from an automatic feed position towards the image forming device to the manual feed position.

22. A mechanism for feeding single sheets of paper manually, and automatically from a stack of papers, comprising:

a paper tray for holding the stack of papers, a feed roller means; and a guide plate means having a groove at an end thereof for accommodating the feed roller when the guide plate means is at a manual feed position, the guide plate means for deflecting manually fed papers from being caught in the paper tray when the guide plate means is at the manual feed position, wherein the feed roller means has a flat surface and is mounted to a shaft which is fixed in position with respect to the paper tray, the feed roller means for engaging with a top sheet of paper from the stack of papers and for feeding the top sheet of paper out of the stack of papers during an automatic feeding operation, and the feed roller remaining stationary during the manual feed operation.

23. A mechanism according to claim 22, wherein:

the feed roller means is rotatable when the guide plate means is at the manual feed position.

24. A mechanism according to claim 22, wherein:

the guide plate means is slidably extendable from an automatic feed position towards the feed roller means to the manual feed position.

* * * * *

UNITED STATES PATENT AND TRADEMARK OFFICE

CERTIFICATE OF CORRECTION

PATENT NO. : 5,695,182

DATED : December 9, 1997

INVENTOR(S) : Noriaki SEKINE, et al.

It is certified that error appears in the above-identified patent and that said Letters Patent is hereby corrected as shown below:

On the title page, item [75] should be:

--[75] Inventor: Noriaki Sekine, Iwatsuki, Japan--

Signed and Sealed this

Twenty-fourth Day of February, 1998

*Attest:*

Bruce Lehman

BRUCE LEHMAN

*Attesting Officer*

*Commissioner of Patents and Trademarks*